US007624885B2

(12) United States Patent
Pfau

(10) Patent No.: US 7,624,885 B2
(45) Date of Patent: Dec. 1, 2009

(54) CONTAINER ARRANGEMENT

(75) Inventor: Dieter Pfau, Elkenroth (DE)

(73) Assignee: WEW Westerwälder Eisenwerk GmbH, Weitefeld (DE)

( * ) Notice: Subject to any disclaimer, the term of this patent is extended or adjusted under 35 U.S.C. 154(b) by 273 days.

(21) Appl. No.: 11/092,295

(22) Filed: Mar. 28, 2005

(65) Prior Publication Data

US 2006/0163246 A1 Jul. 27, 2006

(30) Foreign Application Priority Data

Jan. 26, 2005 (DE) ..... 20 2005 001 260 U

(51) Int. Cl.
*B65D 88/00* (2006.01)
*B65D 6/16* (2006.01)

(52) U.S. Cl. ..... 220/1.5; 220/4.28

(58) Field of Classification Search ..... 220/4.16, 220/4.12, 4.02, 4.01, 647, 668, 562, 507, 220/505, 503, 23.89, 23.86, 254.6, 254.3, 220/254.1, 259.1, 256.1, 676, 522, 525, 523, 220/826, 810, 4.33; 206/600; D9/420
See application file for complete search history.

(56) References Cited

U.S. PATENT DOCUMENTS 1,100,157 A * 6/1914 Spalding ..... 220/522
1,336,896 A * 4/1920 Driver et al. ..... 220/1.5
1,995,331 A * 3/1935 Snyder et al. ..... 134/58 D
2,417,979 A * 3/1947 Gilmore ..... 220/1.5
2,984,084 A * 5/1961 Talmey et al. ..... 62/239
2,985,482 A * 5/1961 Lion ..... 220/1.5
3,118,559 A * 1/1964 Stricker, Jr. ..... 220/62.18
3,912,103 A * 10/1975 Gerhard ..... 220/1.5
3,966,075 A * 6/1976 Schultz ..... 220/1.5
4,376,489 A * 3/1983 Clemens ..... 220/1.5
4,506,798 A * 3/1985 Goutille ..... 220/1.5
4,730,748 A * 3/1988 Bane ..... 229/103.11
4,787,181 A * 11/1988 Witten et al. ..... 52/79.1
4,882,912 A * 11/1989 Fossey ..... 62/297
4,953,730 A * 9/1990 Prime et al. ..... 217/4
5,076,458 A * 12/1991 Weiner et al. ..... 220/23.86
D336,157 S * 6/1993 Bunger ..... D3/201
5,285,900 A * 2/1994 Swingler ..... 206/508

(Continued)

FOREIGN PATENT DOCUMENTS

FR 2 821 307 A 2/2001

(Continued)

OTHER PUBLICATIONS

European Search Report, European Application No. EP 05 02 7531; mailing date, Mar. 27, 2006 (6 pp.).

*Primary Examiner*—Anthony Stashick
*Assistant Examiner*—Robert J Hicks
(74) *Attorney, Agent, or Firm*—Frost Brown Todd LLC

(57) ABSTRACT

The present invention relates to a container arrangement having a frame (4) supporting a tank (2) and an equipment compartment (3), whereby the equipment compartment (3) is accessible by means of a closeable aperture (9) arranged in an exterior wall (5) of the equipment compartment and whereby the exterior wall (5) is connected with the container frame (12', 12", 13) in a demountable fashion. The frame (4) may be composed of frame modules (4', 4", 4'"), which are solidly interconnected by means of detachable coupling elements (41).

14 Claims, 4 Drawing Sheets

U.S. PATENT DOCUMENTS

| | | | | |
|---|---|---|---|---|
| 5,323,911 | A * | 6/1994 | Johnston et al. | 206/600 |
| 5,370,256 | A | 12/1994 | Fourie et al. | |
| 5,406,993 | A * | 4/1995 | McGarvey | 141/198 |
| 5,507,405 | A * | 4/1996 | Thomas et al. | 220/1.5 |
| 5,725,118 | A * | 3/1998 | Slager et al. | 220/4.28 |
| 6,012,598 | A * | 1/2000 | Antoniou | 220/1.5 |
| 6,032,815 | A * | 3/2000 | Elstone | 220/6 |
| 6,811,048 | B2 * | 11/2004 | Lau | 220/1.5 |
| 2002/0148381 | A1 * | 10/2002 | Norton et al. | 105/355 |
| 2004/0238400 | A1 * | 12/2004 | Knutsson et al. | 206/600 |

FOREIGN PATENT DOCUMENTS

| | | | |
|---|---|---|---|
| GB | 2119759 | A * | 11/1983 |
| GB | 2 246 337 | A | 8/1990 |
| JP | 2000052982 | A * | 2/2000 |
| JP | 2003 285895 | A | 7/2003 |
| JP | 2004 003705 | A | 8/2004 |

* cited by examiner

CONTAINER ARRANGEMENT

CROSS-REFERENCE TO RELATED APPLICATIONS

The present patent application claims priority from German Patent Application No. 20 2005 001 260.2, filed on Jan. 26, 2005 all of which is incorporated herein by reference in its entirety.

BACKGROUND OF THE INVENTION

The present invention relates to a container arrangement, specifically a tank container, having a tank disposed in a frame. In addition, the frame also comprises an equipment compartment with pumps, dispensers, or equipment for the preparation, treatment, or handling (filling, evacuation) of the contents of the tank arranged therein. Such container arrangements are used, for example, as mobile supply stations, gas stations, or water treatment installations. A tank herein refers to a container for fluids, gases, or bulk materials, or a process container wherein said products are treated or handled, or are active in another way (heat exchanger, generator, fuel cell unit, and such).

Both the actual tank and the equipment compartment are generally arranged within the external perimeter of the container frame. The external perimeter can meet international standards. The entire unit can be completely transferred, transported, or operated as a substantially independent unit at the place of operation thereof.

Containers which are mainly used as a means of transportation generally only have very small equipment compartment, which usually only comprise a shut-off device at the lower front end, or access apertures and/or safety or filling and evacuation apparatuses disposed on the apex of the tank. In such containers, said apparatuses are arranged in relatively small valve housings or hood cases, which can be closed with shutters or sliding shutters.

However, when a container is used as a stationary supply unit, complex equipment or installation components in the container unit are often arranged in the container unit. They are disposed in larger equipment compartments in order to protect them against environmental effects, unauthorized operation, or to prevent sabotage. Said equipment compartment can be accessed by means of closeable doors or lockable interstices, as the case may be, and are often large enough to be entered by a person. Even though the actual equipment are accessible and can be operated, they often only have a very limited volume, making it difficult or impossible to carry out extensive maintenance work on or repairs of the equipment installed in the equipment compartment due to a lack of space. Oftentimes, the equipment are also so large that it is even impossible to fit them through an open door. This problem is solved during the construction of the container by installing said equipment and connecting them to the container frame before mounting the actual equipment compartment and the exterior walls thereof. The equipment compartment or the exterior walls cannot be disassembled, or only in a very invasive manner and in a specialized workshop instead of at the place of operation. Removal of the equipment is very expensive and involves additional transportation or higher expenses since containers that are being used as supply units are often located far away from the necessary transportation and servicing logistics.

SUMMARY OF THE INVENTION

The object of the present invention is to improve the accessibility of the components and equipment arranged in the equipment compartment, disregarding the place of operation (e.g., remote locations, war regions, or regions in crisis) of the container or supply station built as a container unit.

This object is being met by a container according to Claim 1 whereby at least one exterior wall of the equipment compartment is demountable. This way, the access area to the equipment and equipment arranged in the equipment compartment can be considerably enlarged, i.e., even large equipment can be easily and quickly replaced or conveniently serviced. Upon completion of the work, the exterior wall can be re-assembled and attached to the container frame, and the equipment compartment can be closed. The term "demountable" is used here in the sense of "removable and mountable in or to."

The departure according to Claim 2 provides an arrangement wherein said exterior wall comprises a plurality of demountable wall elements, which are flat for practical reasons. This way, the individual elements are easy to handle and can be removed and mounted "by hand" without any additional lifting equipment. Particularly in the case wherein the walls are made of steel plate or isolated steel or metal elements, or connecting elements having a metallic top for security/safety or stability reasons, individual elements which are relatively light can be obtained. The second advantage consists of the fact that, depending on the situation, only those elements necessary for the work in question need to be removed instead of having to remove the entire wall.

The departure according to claim 3 describes a wall element comprising a door which generally opens to the outside and has a lockable opening therein. Therefore, the wall element can be completely removed without having to remove the door.

The exterior wall or an exterior wall element, respectively, can also comprise a functional module, which is accessible from the outside, such as a switch box, a connection armature, a box for spare parts of the armatures, tools, or other components. This functional module can then be completely removed, together with the wall or the wall element, and serviced or replaced without having to do this in the limited space of the equipment compartment or in bad weather such as rain, snow, or stormy weather.

According to Claim 5, the exterior wall can also be heat insulated or soundproofed, thus keeping the stored goods from being exposed to unwanted thermal effects, for example, when the equipment compartment contains treatment equipment for the contents of the container (drinking water treatment, dosage equipment, heating).

Claims 6-9 provide especially advantageous embodiments for mounting the exterior wall or the exterior wall elements to the container frame. Supporting frame elements such as corner posts, traverse or transverse sleepers having a group of fastening elements (claim 6) are particularly suitable for mounting the exterior wall. This group of fastening elements comprises one or several groove elements, relative fastening, and sealing elements (Claim 7), whereby the groove element attaches the connecting surface of the exterior wall and forms the connection with the actual frame element. The equipment compartment is shielded against exterior influences by means of a reusable seal such as an elastic hollow section seal. This way, elaborate sealing measures after mounting the side wall become unnecessary.

According to Claim 10, the fastening element for attaching the exterior wall to the groove element or the frame element can be embodied as a screw connection. Other detachable connections can also be provided, such as snap connections or clamp connections and the like.

In order to obtain good accessibility to the equipment compartment and the most compact dimensions, the equipment compartment according to Claim 11 is disposed at one front end of the tank. This makes it possible to optimize the relationship between the interior space and the exterior upper space, from a thermal perspective, on the one hand, and to guarantee a relatively good usage of the volume of the cuboid frame with a cylindrical tank on the other hand.

The exterior wall of the departure according to Claim 12 is laid out and sealed in the frame in such a way that the equipment compartment is protected against dust and splash water, thus extending the life and reliability of the components operated in the equipment compartment.

In the departure according to Claim 13, the equipment compartment are arranged on both front sides, thereby securing that the center of gravity of the container is substantially located in the center of the container, thus avoiding unbalanced load distribution, which has a negative impact on handling. The departure according to Claim 14 relates to a container having a frame configured of couplable frame modules, which enables a module to house the tank and an additional module in the equipment compartment. Such departure makes it possible to handle the container in one piece and disassemble it into individual modules. It is also possible to combine different modules into different complete units (containers). According to Claim 15, the mechanical coupling takes place independent of the functional coupling by means of relative intersections, thus securing that, for example, functional connections (pipes, energy supply, controls, etc.) are configured independently of the mechanical coupling so that the functional intersections are not exposed to additional mechanical loads.

BRIEF DESCRIPTION OF THE DRAWINGS

The following is a clarification of one example of the embodiment of the present invention by reference to the drawings, wherein.

DETAILED DESCRIPTION OF THE INVENTION

Figure 1:
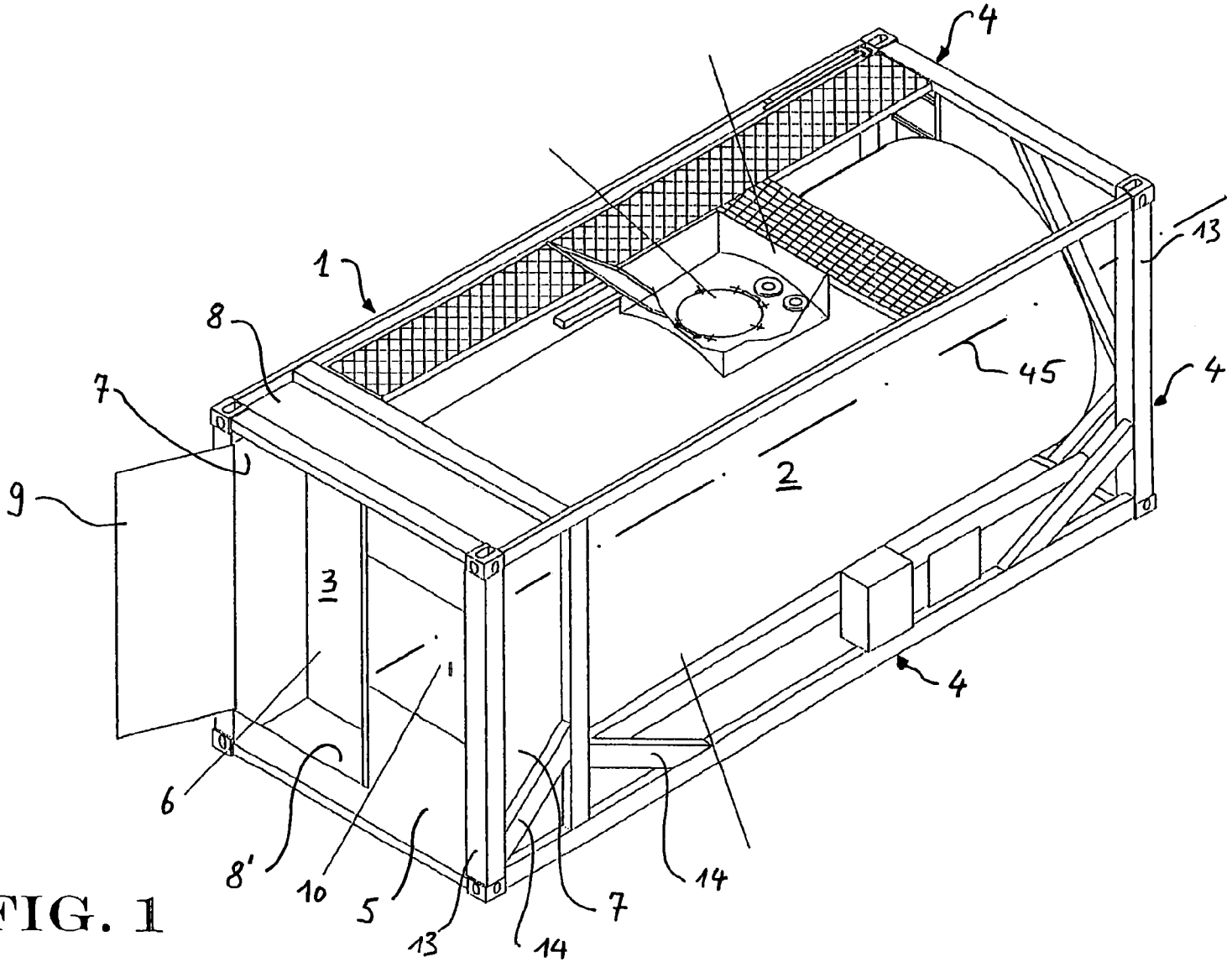
FIG. 1 is a perspective schematic view of a container according to the invention.

The tank container 1 illustrated in FIG. 1 comprises a tank 2 having a tank axis 45, an equipment compartment 3, and a frame 4, and having equipment arranged in the equipment compartment 3. The equipment compartment 3 is defined by exterior walls 5, 6, 7, and 8. The back wall 6 is disposed between the front end of the tank and the equipment compartment 3; the side walls 7, and the top or bottom walls 8, 8' are disposed lengthwise of the tank container 1, and the front wall 5 closes off the equipment compartment 3 at the foremost end of the tank container 1. The front wall comprises a door 9 swinging to the outside and shown herein in an open condition. Moreover, a switch box 10 has been disposed. The frame 4 of the tank container 1 is comprised of, amongst others, traverse and transverse sleepers 12', 12", and corner posts 13, which are interconnected 14. The front wall 5 of the illustrated embodiment shown is demountable. Other embodiments exist wherein the back wall 6 and the side walls 7, or the bottom and top wall 8', 8 are demountable.

Figure 2:
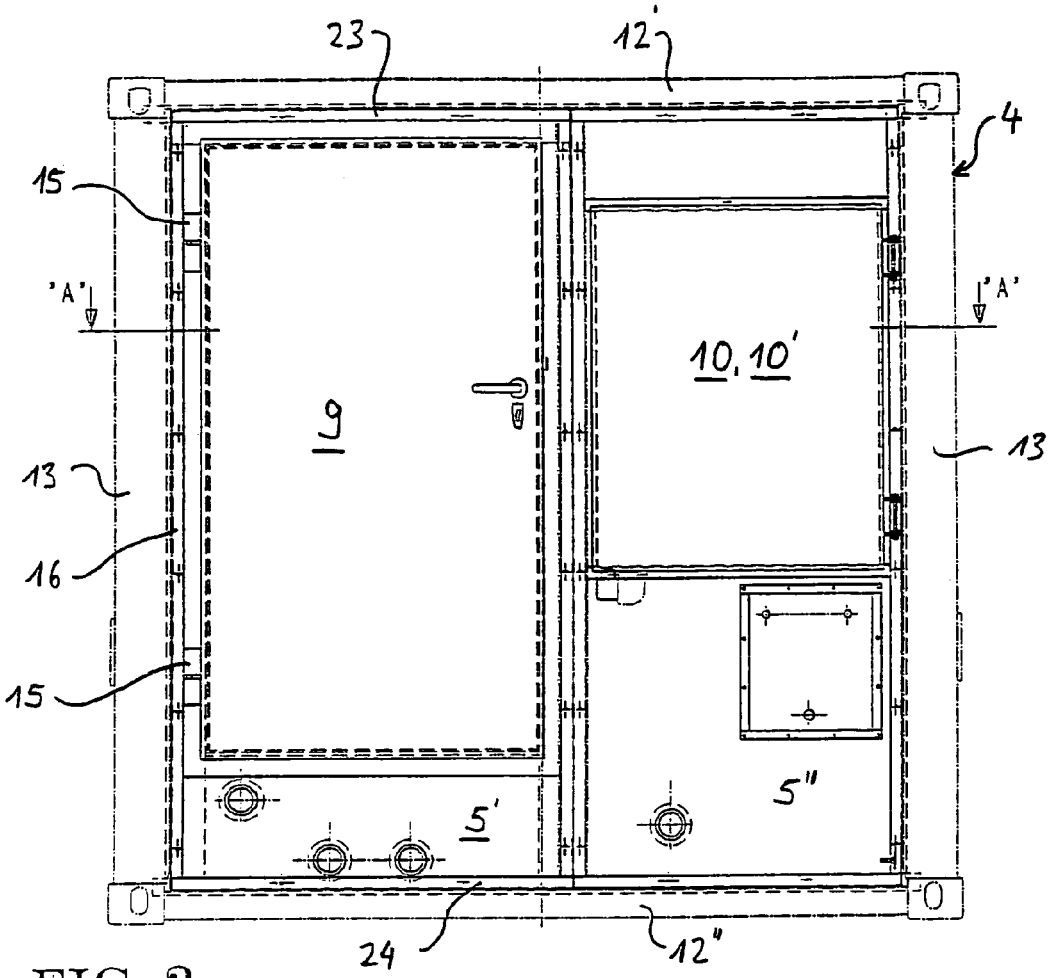
FIG. 2 is a front view of the container of FIG. 1.

FIG. 2 illustrates a front view of the front wall 5 comprising both wall elements 5' and 5". The door 9 in the front wall element 5' is arranged over two relative hinges 15. The switch box 10 is locked with a lockable shutter 10'. The frame 4 is marked with a segmented line.

Figure 3:
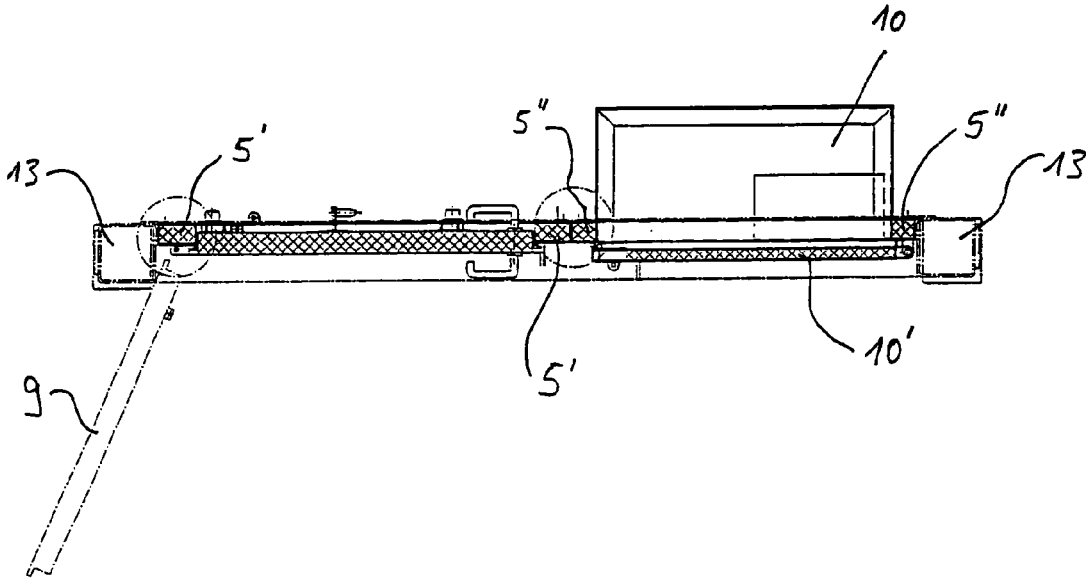
FIG. 3 is a cross-section A-A of the front wall illustrated in FIG. 2.

FIG. 3 is a cross-section illustrating that both the front wall elements 5' and 5" and the door 9 and the shutter 10 are made of insulated sandwich material. The switch box 10 itself is also disposed on the front wall element 5" and can be removed together with said element. The attachment of the front wall elements 5' and 5" can be seen in FIGS. 4, 5, and 6. The corner posts 13 shown in FIGS. 2 and 3 (shown in part in FIGS. 4 and 5) illustrates a frame element 16 disposed about the surface facing the tank and attached with two welds 17, 18. Several threaded bolts 19 are arranged about the rearward surface (facing the tank) of the wall element 5', which intersperse the relative borings 20 in the frame element 16 and are attached with nuts 21. The diameter of the borings 20 is slightly larger than the diameter of the threaded bolts 19 in order to allow for manufacturing tolerances. This way, the wall element can be aligned prior to tightening the screws.

Figure 5:
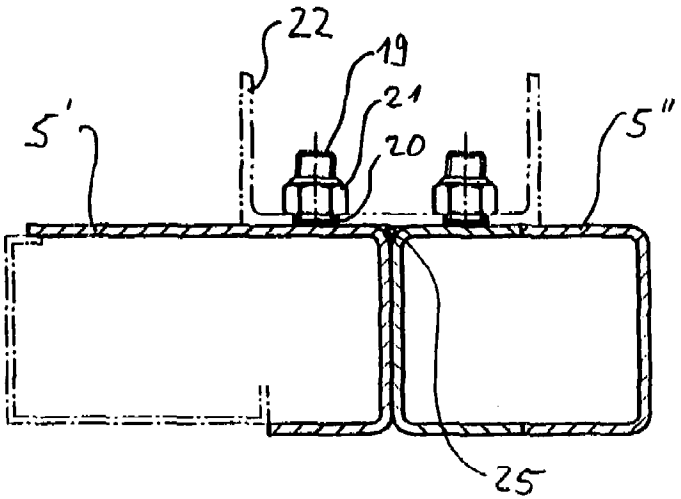
FIG. 5 is a detailed view of an alternative group of connections and wherein the wall element is illustrated over a grooved rail connecting the upper and lower transverse sleepers.

FIG. 5 shows the attachment of the right side of the wall element 5' and the left side of the wall element 5" about a U-shaped beam 22 vertically disposed between the upper and lower transverse sleeper 12', 12", whereby said U-shaped beam 22 also has relative apertures 20 hosting the threaded bolts 19, which in turn are attached with nuts 21. The top and bottom sides of the front wall elements 5' and 5" are attached about relative frame elements 23 and 24, which are attached to the relative transverse sleepers 12', 12" (see FIG. 2).

Figure 4:
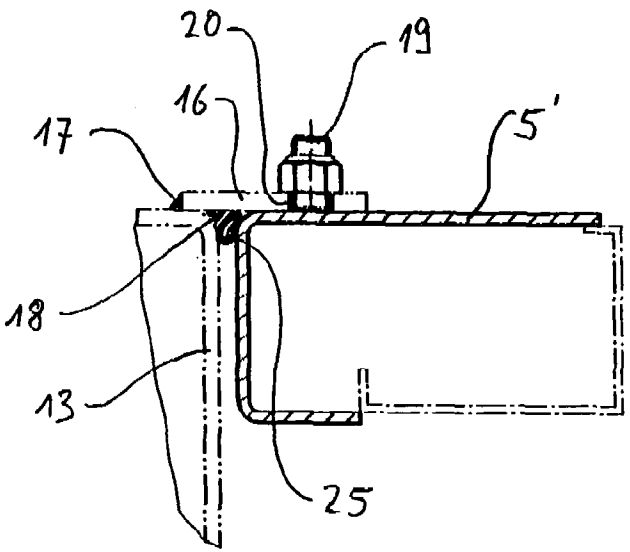
FIG. 4 is an individual view of a group of connections connecting a wall element with a corner post.
Figure 6:
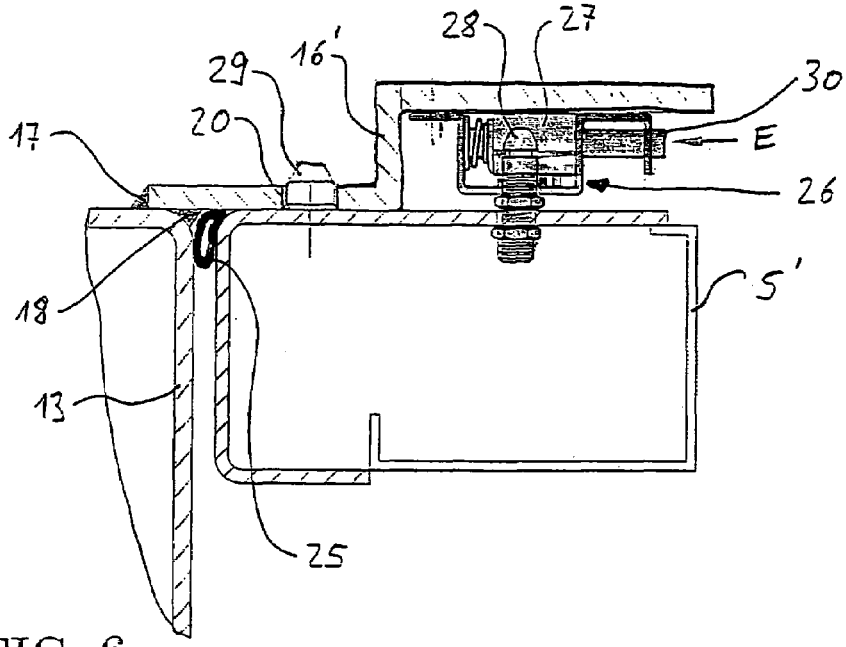
FIG. 6 illustrates an alternative connection element (snap connection)

Relative sealing elements 25 are disposed between the front wall elements 5' and 5" and the frame elements (transverse sleepers 12', 12", corner posts 13) (FIGS. 4, 5, and 6). The sealing element 25 is inverted here in the corner between the corner post 13, frame element 16, and wall element 5' or 5", and completely seals the interior space.

The back, top and bottom wall 6, 8, 8' or the side walls 7, respectively, of the embodiment shown are solidly interconnected with, e.g. welded to, the frame 4. However, they can also be arranged in a demountable fashion, analogous to the front wall elements 5', 5". The screw connections can be accessed from the equipment compartment 3 and cannot be unscrewed from the outside. Dismantling is done by untightening the nuts 21, whereupon each front wall element 5', 5" can be completely removed together with the door 9 or the switch box 10. The equipment compartment 3 is then completely accessible from the front through the aperture defined by the corner posts 13 and the transverse sleepers 12', 12". Re-assembly is done by reversing the procedure, i.e., placing the front wall elements 5', 5" and the threaded bolts 19 in the apertures 20 and screwing them thereto.

FIG. 6 illustrates a plug-snap connection 26 as an alternative for the screw connection shown in FIGS. 5 and 6, whereby the wall element 5' only needs to be plugged in a lock 27 by means of a bolt 28, and is then snapped into place. The snap connection can then be unsnapped by moving an unlocking pin 30 in the direction of the arrow (E) from inside the equipment compartment 3. This assembly allows for a particularly timesaving mounting of the wall elements 5', 5" without tools. In addition, a centering piece 29 is provided, which aligns the wall element 5', 5" and the frame element 16' in the aperture 20 and absorbs transverse forces.

Figure 7:
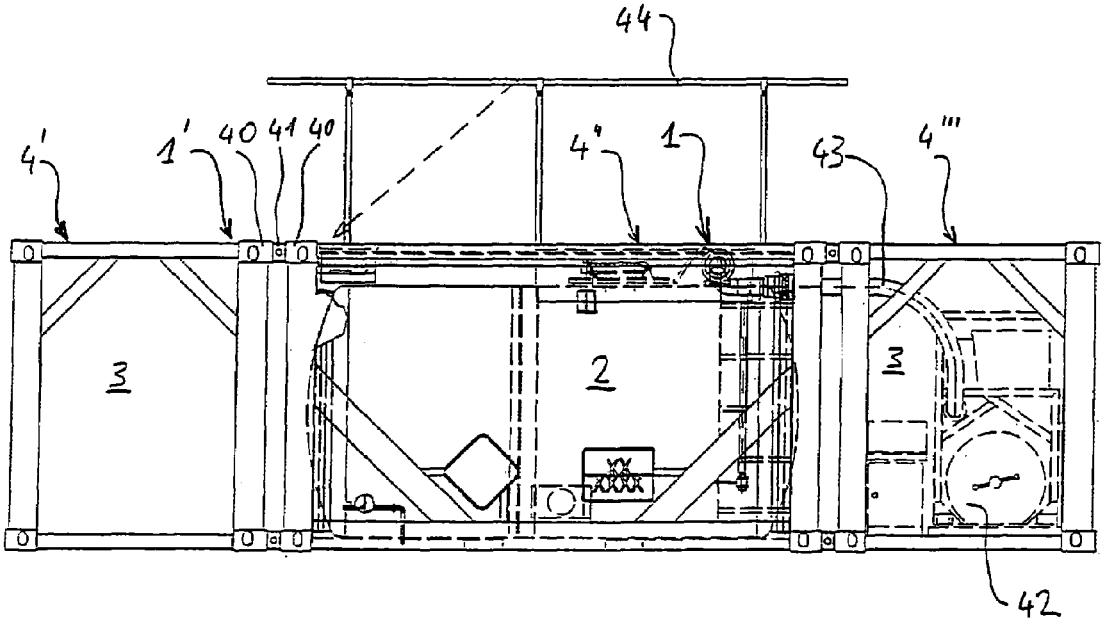
FIG. 7 illustrates a container having the tank and the equipment compartments arranged in a frame composed of a plurality of couplable frame modules.

FIG. 7 illustrates a different embodiment of a container arrangement, wherein the frame 4 comprises three frame modules 4', 4", and 4''', which are interconnected at their respective container corners 40 by means of detachable mechanical coupling elements 41. The frame module 4" incorporates the tank 2 and is designed as a tank container, whereas the modules 4' and 4''' comprise equipment compartment 3 with a module 4''' having a pump unit 42 arranged therein and connected with the tank 2 by means of a conduit 43. The module 4' can be accessorized with additional components and equipment. The equipment compartment 3 arranged in the modules 4' and 4''' are also defined by exterior walls, whereby each time at least one wall is demountable and comprises a closeable aperture. The flexibility of such container arrangement is further increased by the fact that different modules 4', 4", 4''' can be connected with one another, and can be handled as a unit or individually. Moreover, the individual equipment is accessible through apertures and the removable walls in the way you prefer. The wall is further provided with a drop rail 44 allowing to safely work on the equipment.

One application might consist, for example, of a tank 2 comprising a fuel cell module being supplied by a fuel processing unit arranged in the module 4''', and the module 4' being equipped with a unit power generation unit, for example (e.g. conversion of direct current into alternate current). The fuel processing unit can be fitted depending on the fuel used (natural gas, methane, methanol, diesel), whereas the unit 4' is only needed when a conversion of direct current into alternate current is necessary. Furthermore, it is also possible to attach an additional tank unit containing the actual fuel. All this allows for a complete, custom-fit energy supply unit. The modules can also be connected horizontally (next to each another, one behind the other) or vertically (on top of each other).

In other embodiments, the walls 5, 6, 7, 8, 8' are designed as penetrable grid elements or transparent window elements.

Additional variations and alternatives are obvious to a person skilled in the art, based upon the following claims.

What is claimed:

1. A container arrangement comprising:

a frame;

a tank supported by and enclosed within the frame; and an equipment compartment supported by and enclosed within the frame and enclosed by at least one exterior wall, wherein the equipment compartment is accessible through a closeable aperture arranged in a portion of the at least one exterior wall of the equipment compartment, wherein the at least one exterior wall is connected with the container frame and the at least one exterior wall is connected in a demountable fashion and can be disconnected, together with the closeable aperture arranged in the portion of the at least one exterior wall, from the container frame.

2. The container arrangement according to claim 1, wherein the exterior wall comprises a plurality of demountable, flat wall elements.

3. The container arrangement according to claim 1, wherein the closeable aperture comprises a door swinging in an outward direction.

4. The container arrangement according to claim 1, wherein the exterior wall supports a functional module, which is accessible from the outside, wherein the functional module comprises one or more of the following:

a switch box, an armature, or a box for spare parts, tools, or components.

5. The container arrangement according to claim 1, wherein the exterior wall is heat insulated or soundproofed.

6. The container arrangement according to claim 1, wherein the exterior wall is connected with a frame element of the frame by a group of fastening elements.

7. The container arrangement according to claim 6, wherein the group of fastening elements have at least one groove element, an attachment element, or a sealing element.

8. The container arrangement according to claim 7, wherein the groove element defines a connection surface for the exterior wall and by being solidly interconnected with a frame element.

9. The container arrangement according to claim 7, wherein the sealing element is reusable sealing.

10. The container arrangement according to claim 7, wherein the fastening element is a screw connection or a snap connection.

11. The container arrangement according to claim 1, wherein the equipment compartment is arranged at one front end of the tank.

12. The container arrangement according to claim 1, wherein the equipment compartment is protected against dust and splash water by the exterior wall.

13. The container arrangement according to claim 1, further comprising:

a second equipment compartment, the two equipment compartments, each being substantially symmetrically arranged at the end of the container so as to have the center of gravity of the arrangement near a center plane which is perpendicular to a tank axis.

14. A container arrangement comprising:

a first frame module;

a tank supported by and enclosed within the first frame module;

a second frame module, wherein the first and second frame modules are detachably coupled with each other; and an equipment compartment supported by and enclosed within the second frame module and enclosed by at least one exterior wall, wherein the equipment compartment is accessible through a closeable aperture arranged in a portion of the at least one exterior wall of the equipment compartment, wherein the at least one exterior wall is connected with the container frame and the at least one exterior wall is connected in a demountable fashion and can be disconnected, together with the closeable aperture arranged in the portion of the at least one exterior wall, from the container frame, and the tank and at least one piece of equipment within the equipment compartment are functionally coupled, wherein the functional coupling is independent of the mechanical coupling of the frame modules.

* * * * *